US006106314A

United States Patent [19]

McLean et al.

[11] Patent Number: 6,106,314

[45] Date of Patent: Aug. 22, 2000

[54] COAXIAL JACK WITH INTEGRAL SWITCH AND SHIELDED CENTER CONDUCTOR

[75] Inventors: Norris B. McLean, Englewood; Joseph P. Savicki, Clinton, both of N.J.

[73] Assignee: Lucent Technologies, Inc., Murray Hill, N.J.

[21] Appl. No.: 09/346,095

[22] Filed: Jul. 1, 1999

[51] Int. Cl.[7] ..... H01R 29/00

[52] U.S. Cl. ..... 439/188; 200/51.1

[58] Field of Search ..... 439/188; 200/51.1

[56] References Cited

U.S. PATENT DOCUMENTS

| | | | |
|---|---|---|---|
| 4,815,104 | 3/1989 | Williams et al. | 375/36 |
| 5,280,254 | 1/1994 | Hunter et al. | 439/188 |
| 5,702,262 | 12/1997 | Brown et al. | 439/188 |
| 5,882,217 | 3/1999 | Aponte et al. | 439/188 |

*Primary Examiner*—Renee Luebke
*Assistant Examiner*—T. C. Portel
*Attorney, Agent, or Firm*—Duane, Morris & Heckscher LLP

[57] ABSTRACT

A coaxial jack with an internal switch mechanism and a shielded signal conductor includes a cylindrical shell having an axial opening, and an elongate signal conductor supported coaxially inside the shell, and surrounded by a shield that includes an access window positioned so that a portion of the signal conductor is accessible. A back end of an elongate resilient switch contact is fixed by a switch contact support at a back portion of the shell on one side of the shell axis. The switch contact extends inside the shell toward the front opening at a certain inclination and has a free end located on a side of the shell axis opposite the one side. The switch contact is configured and positioned to make an electrical connection with the signal conductor, via the access window in the shield, in the absence of a mating plug. An elongate actuator is supported on the inner periphery of the shell and has an engaging part that protrudes into a defined plug travel path inside the shell. The engaging part is configured to cause the free end of the switch contact to deflect by an amount sufficient to break the electrical connection between the contact and the center conductor when a mating plug travels into the shell and displaces the engaging part of the actuator.

20 Claims, 4 Drawing Sheets

COAXIAL JACK WITH INTEGRAL SWITCH AND SHIELDED CENTER CONDUCTOR

BACKGROUND OF THE INVENTION

Field of the Invention

The present invention relates to coaxial jack interconnection devices, and more particularly to a coaxial jack having a shielded center conductor and an internal switch mechanism.

Type 440 coaxial jacks, which are compatible with type 440 plugs, are known generally for use in telephone cross-connect systems. One such system, known as System III DSX-3/4, has been used in telecommunication networks in the United States. System III DSX-3/4 is used to manually cross-connect DS3, STS1, STS3 or DS4 level signals manually at a central office.

System III DSX-3/4 includes a DSX-3/4 module into which is housed a 3-inch by 3-inch by 0.5 inch die cast metal case, that includes a set of five type 440 jacks. Three mechanical switches are interposed between four of the jacks. The switches have activators and contacts that enter side openings in the jack barrels to sense an inserted plug. See, e.g., U.S. Pat. No. 4,815,104 (March 1989). The five type 440 jacks open on a front panel of the case, and two bulk head type BNC jacks are mounted on a rear panel of the case. Other components inside the case include two hand-soldered coaxial cables, a metal housing for the five type 440 jacks, three resisters, and one inductor. The case is often referred to as a 1201A jack set.

In U.S. Pat. No. 5,882,217, a coaxial jack having an internal switch mechanism is provided that facilitates the incorporation of a printed wiring board to form a DSX-3 module. Another cross-connect system, the DIXI-3, has been used in telecommunication networks. The DIXI-3 system is used to interconnect and cross-connect DS3, STS1 and STS3 signals manually in a central office. The DIXI-3 system includes a DIXI-3 module that is housed in a 0.75-inch by 5.5-inch by 6.0-inch plastic case. The DIXI-3 case houses a printed wiring board with eight right-angle BNC connectors. Because the DIXI-3 system is a rear-cabled, rear cross-connected system, four BNC connectors are located at a rear end of the module and four BNC connectors are located at a front end of the module. The BNC connectors at the rear are for cabling and cross-connecting operations, and the BNC connectors at the front are for patching and monitoring. Migration from the earlier mentioned DSX-3 system with type 440 jacks to a DIXI-3 system may be simplified by substitution of the type 440 jacks provided in U.S. Pat. No. 5,882,217 for the aforementioned BNC jacks, for patching and monitoring on the DIXI-3 modules.

Prior art type 440 coaxial jacks, such as that disclosed in U.S. Pat. No. 5,882,217, with an internal switch assembly, can sustain transmission rates as high as 55 Mb/s. However, above this rate the presence of unshielded regions in the jack may significantly degrade the transmission performance of the device. In particular, the unshielded contact mating area of such prior art coaxial jacks may be the source of significant deterioration of the transmitted signal. This is because the center conductor of the jack is in close proximity to the normally opened and common contacts of the switch assembly. Such switch assemblies and contacts have not, heretofore, been adequately electrically isolated from the center conductor to provide for transmission rates above 55 Mb/s. Thus, there is a need for a type 440 coaxial jack that is either straight mount or right-angled, having an internal switch, and which includes a center conductor that is electrically isolated from an associated switching mechanism.

SUMMARY OF THE INVENTION

According to the invention, a coaxial jack with an internal switching mechanism and shielded signal conductor comprises a housing supporting a cylindrical shell having an axial front opening and defining a plug travel path inside the shell for a mating plug. An elongate signal conductor is supported coaxially inside the shell to connect to a corresponding conductor of the plug. The center conductor is shielded and electrically isolated from the bulk of the switching mechanism in order to enhance the high frequency transmission characteristics of the connector. The electrical isolation is provided by a first conductor shield positioned in surrounding relation to a first portion of the signal conductor and a second conductor shield positioned in surrounding relation to a second portion of the signal conductor. The first and second shields are electrically isolated from the signal conductor by insulators. The first conductor shield includes an access window to provide for electrical engagement of the signal conductor along a portion of its length by a corresponding portion of the switch mechanism.

A switch contact support is fixed at a back portion of the shell, and an elongate resilient first switch contact is fixed at a back end by the switch contact support, on one side of the shell axis. The first switch contact extends inside the shell toward the front opening with a predetermined inclination and has a free end positioned on a side of the shell axis opposite the one side. The first switch contact is configured and positioned to make an electrical connection with the signal conductor, through the access window in the first shield, in the absence of a mating plug in the shell.

An elongate actuator is supported on the inner periphery of the shell and has an engaging part that protrudes into the plug travel path. The engaging part is configured to cause the free end of the first switch contact to deflect by an amount sufficient to break the electrical connection between the contact and the signal conductor, when a mating plug travels into the shell and displaces the engaging part of the actuator.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DESCRIPTION OF THE PREFERRED EMBODIMENT

Figure 1:
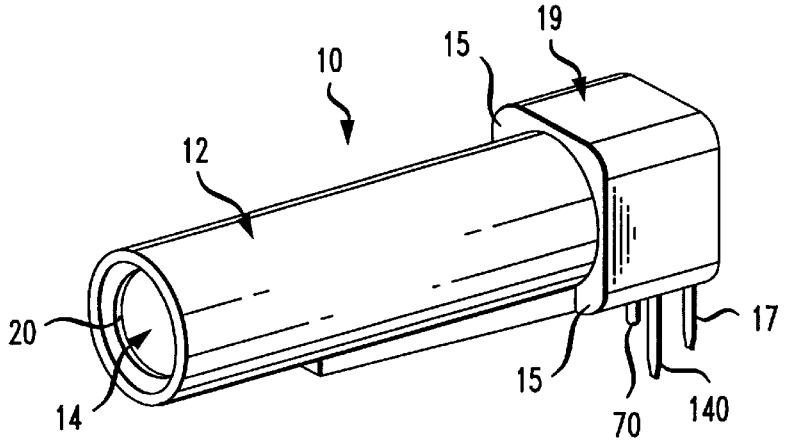
FIG. 1 is a perspective view of a coaxial jack connector formed according to a preferred embodiment of the invention.
Figure 2:
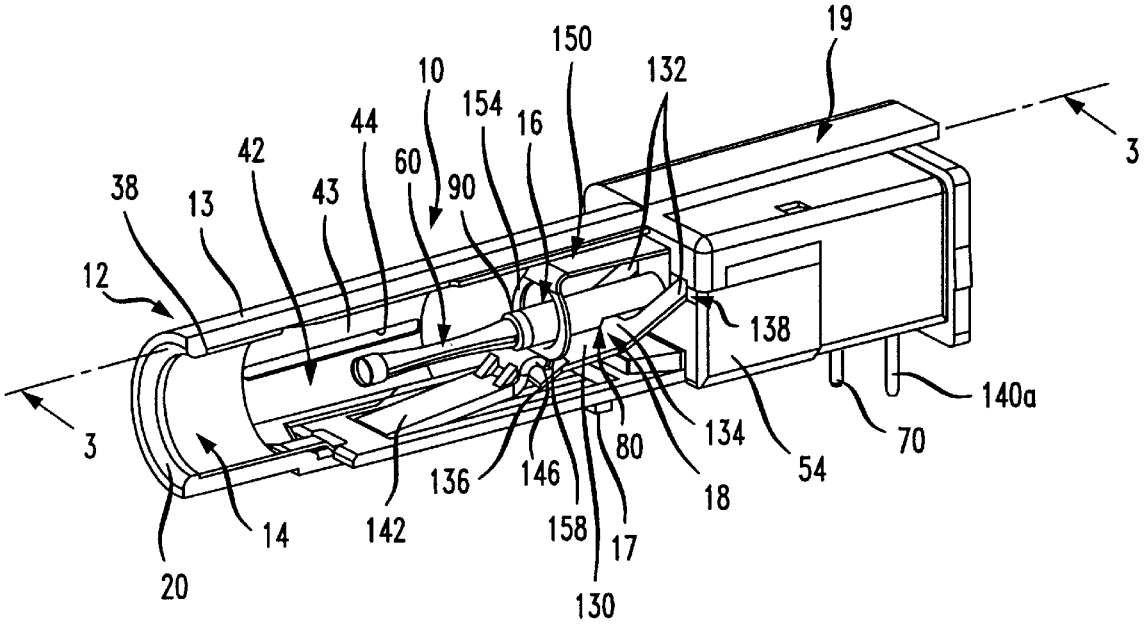
FIG. 2 is a partially broken away, perspective view of the coaxial jack shown in FIG. 1, showing an interior portion of the jack.

Referring to FIGS. 1 and 2, coaxial jack 10 includes a housing 12, a ground spring shell 14, a shielded center conductor assembly 16, and a jack switch assembly 18. More particularly, housing 12 has a cylindrical barrel 13 made, for example, from a molded metalized polymer material or a metal, such as, a zinc alloy, that is capable of conducting to a ground potential. Housing 12 also has a generally rectangular, integrally formed base portion 19. Base portion 19 encloses a base portion of shielded center conductor 16 and jack switch assembly 18, and is preferably formed integrally with cylindrical barrel 13 of housing 12. Base portion 19 has, for example, a square cross-section measuring 0.490 inches on a side. Ledges 15 are formed at the intersection of base portion 19 and cylindrical barrel 13, and facilitate manual handling and mounting of coaxial jack 10 when assembled into a jack module. An opening 20 is formed at one end of cylindrical barrel 13, and is positioned in spaced relation to base portion 19. Opening 20 leads to an interior void within housing 12 that is sized and shaped to accept ground spring shell 14, shielded center conductor assembly 16, and jack switch assembly 18.

Base portion 19 includes compliant mounting pins or lugs 17 projecting from a bottom surface or edge in a defined pattern to engage corresponding mounting holes in a printed wiring board. It will be understood that mounting pins 17 may be arranged in axial alignment with cylindrical barrel 13 of housing 12 or, at right angles to the longitudinal axis of housing 12, in order to facilitate in-line or right angle mounting of coaxial jack 10 to a corresponding printed wiring board. Base portion 19 encloses an interior void that is sized and shaped to accept a portion of shielded center conductor assembly 16. Opening 20 of housing 12 has a diameter of about 0.300 inches. The combined length of barrel 13 and base portion 19, is about 1.870 inches. The length of mounting pins 17 is typically about 0.165 inches.

Figure 3:
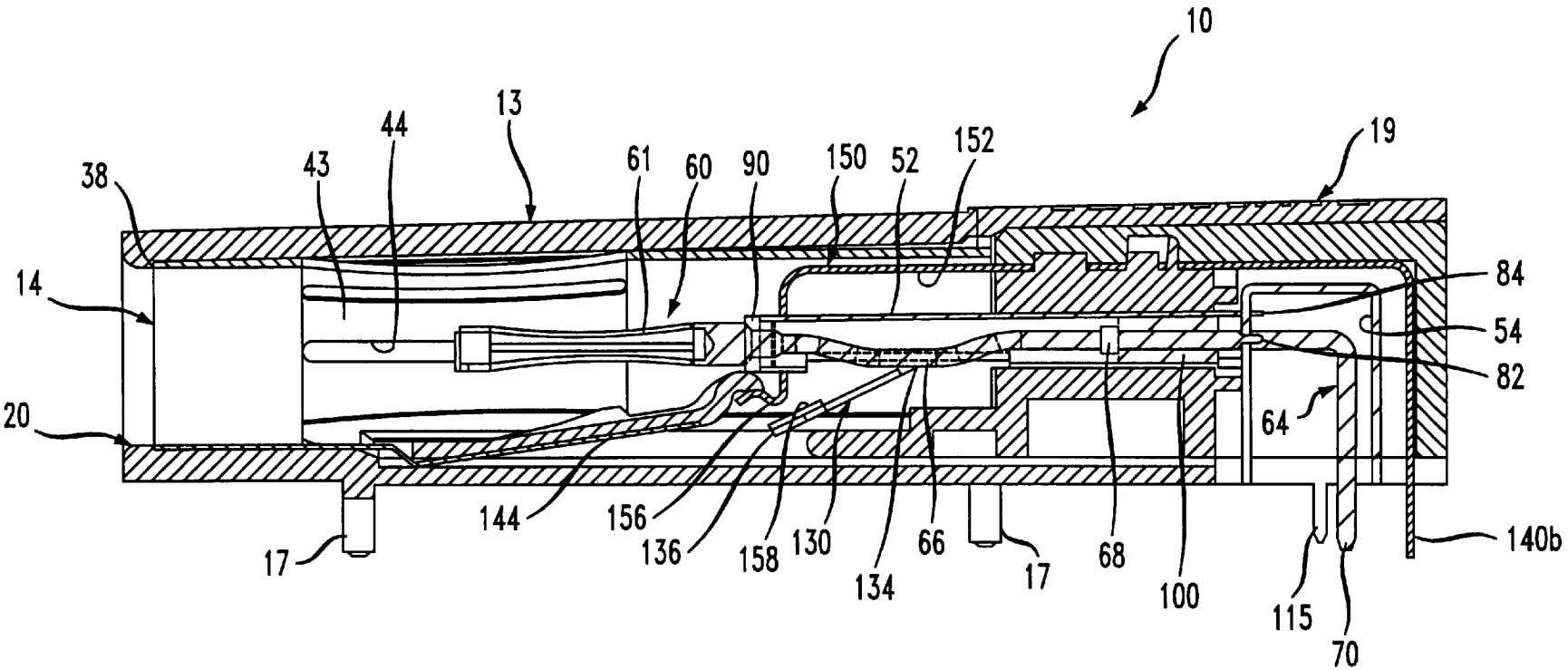
FIG. 3 is a cross-sectional view of the coaxial jack in FIG. 2, as taken along line 3—3 in FIG. 2.

Referring to FIGS. 2 and 3, ground spring shell 14 is supported coaxially along the inner periphery of cylindrical barrel 13, and is arranged in coaxial alignment with opening 20. Ground spring shell 14 defines a path of travel when a mating coaxial plug (not shown) is inserted into coaxial jack 10 through opening 20 when coaxial jack 10 is a type 440 jack. Ground spring shell 14 fits snugly along the inner periphery of cylindrical barrel 13, and is locked against axial movement by an annular lip 38 that protrudes radially inwardly from housing 12 adjacent to opening 20. A section 42 of ground spring shell 14 is positioned adjacent to opening 20 and includes a plurality of axially extending, doubly supported beams 43 that are spaced apart by slots 44. Beams 43 are equi-circumferentially spaced from one another, thus forming a spring constriction plug receptacle in section 42. When a mating plug connector (not shown) is inserted into opening 20, the plug slides against and resiliently deflects beams 43 so as to be held frictionally in place by the spring constriction receptacle. In this way, an effective electrical interconnection may be established between ground spring shell 14 and the body of the plug connector. This electrical interconnection is typically placed at ground potential.

Figure 4:
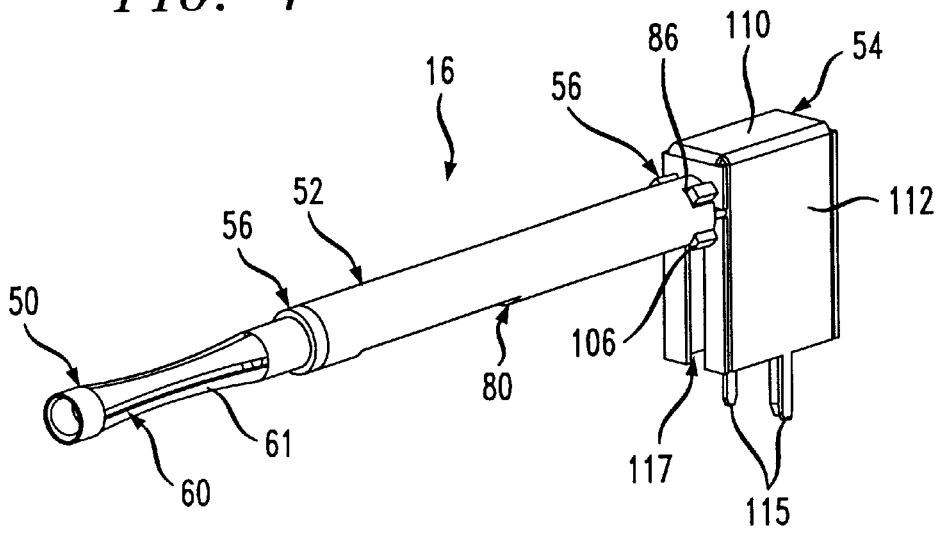
FIG. 4 is a perspective view of a shielded center conductor assembly.
Figure 5:
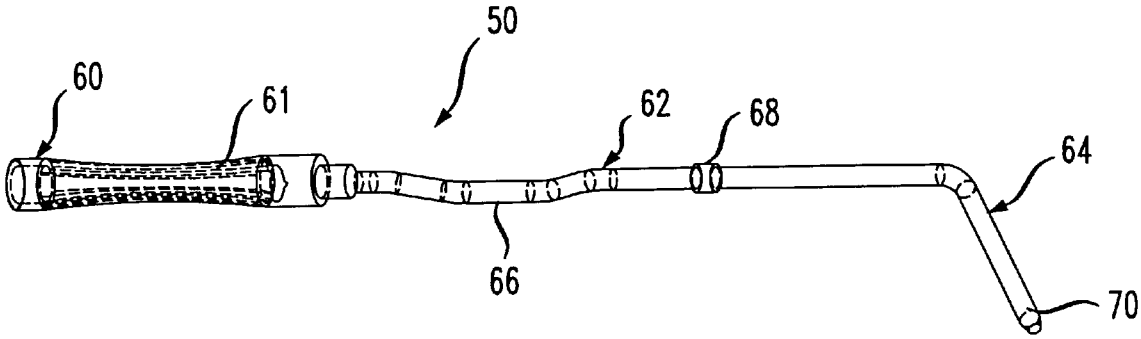
FIG. 5 is a perspective view, partially in phantom, of a signal conductor.

Referring to FIGS. 4–7, shielded conductor assembly 16 includes a signal conductor 50, a barrel shield 52, a base shield 54, and insulators 56. Referring to FIG. 5, signal conductor 50 includes a receptacle 60, a central conductor 62, and a terminal conductor 64. Receptacle 60 is tubularly shaped and includes at least two doubly supported beams 61 which are radiused inwardly so as to form a resilient spring constriction. Receptacle 60 is positioned in substantially coaxially relation to the longitudinal axis of housing 12 when shielded conductor assembly 16 is mounted therein, and is dimensioned to electrically and mechanically engage a corresponding center pin of a mating plug connector.

Figure 7:
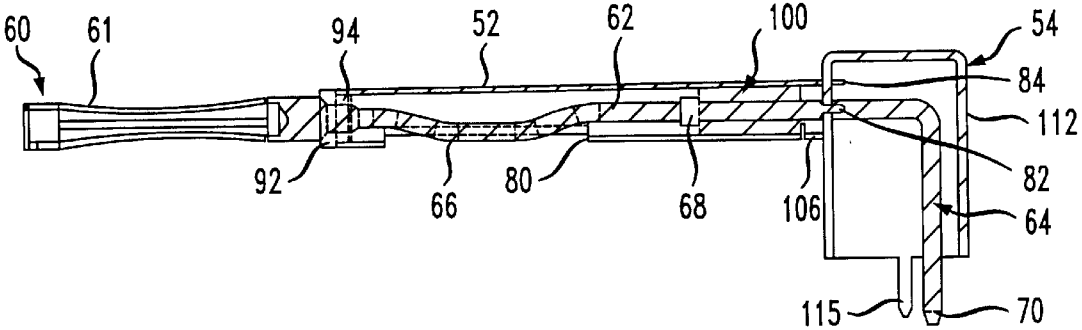
FIG. 7 is a side elevational view, partially in cross-section, of the shielded center conductor assembly shown in FIG. 4.

Central conductor 62 projects axially outwardly from a rear portion of receptacle 60, and includes a radiused section 66 which causes that portion of central conductor 62 to protrude away from the common longitudinal axis of receptacle 60 and central conductor 62. Section 66 is shaped so as to be easily engageable with a portion of jack switch assembly 18, as will hereinafter be disclosed in further detail. An annular stop 68 projects radially outwardly from an end portion of central conductor 62, adjacent to the intersection of central conductor 62 with terminal conductor 64. Terminal conductor 64 is an integral portion of signal conductor 50, and may include a ninety degree bend formed along its length so as to facilitate right-angle mounting of a fully assembled housing 12 to a printed wiring board (FIGS. 3, 5, and 7). A terminal contact pin 70 extends away from the 90° bend, and is sized and shaped to mechanically and electrically engage a receptacle feature positioned on a printed wiring board. Advantageously, signal conductor 50 is electrically shielded from the interior environment of housing 12 by a first or barrel shield 52, a second or base shield 54, and insulators 56. More particularly, barrel shield 52 is formed from a relatively elongate, hollow cylinder formed from an electrically conductive metal or metalized plastic that has an internal diameter sized to receive central conductor 62 without mechanically or electrically engaging it. Barrel shield 52 includes a front opening 76, a rear opening 78, and a centrally disposed access window 80. The portion of barrel shield 52 that is adjacent to rear opening 78 includes a pair of substantially parallel mating tines 82 that are positioned in diametrically spaced relation to one another, and a keying-tine 84 positioned between tines 82. Tines 82 and keying-tine 84 project outwardly in parallel relation to the longitudinal axis of barrel shield 52. A plurality of cut-outs 86 are defined in equi-circumferentially spaced relation to one another on the rear edge of barrel shield 52. Access window 80 is defined by an elongate slot in the wall of barrel shield 52 which provides for mechanical and electrical access to section 66 of central conductor 62, when signal conductor 50 is positioned within barrel shield 52 in a fully assembled coaxial jack 10.

Preferably, two insulators 56 are provided for use in assembling shielded conductor assembly 16, a front insulator 90 and a rear insulator 100. More particularly, front insulator 90 includes a cylindrical stop 92, a central cylindrical projection 94, and a central through bore 96. Central cylindrical projection 94 extends from one side only of cylindrical stop 92, and is sized and shaped to be snugly received within front opening 76 of barrel shield 52, with cylindrical stop 92 engaging the front edge of barrel shield 52. Central through-bore 96 is sized to receive central conductor 62 of signal conductor 50, but is not large enough to allow the rear portion of receptacle 60 to enter or contact barrel shield 52 (FIG. 3). Rear insulator 100 includes a cylinder plug 102, a central through-bore 104, and a plurality of stops 106. Cylinder plug 102 is sized and shaped so as to be snugly received within rear opening 78 of barrel shield 52. Central through-bore 104 is sized to receive central conductor 62 of signal conductor 50, but is not large enough to allow annular stop 68 to enter or extend beyond the rear edge of barrel shield 52 (FIG. 3). Plurality of stops 106 project radially outwardly from the outer surface of the rear portion of insulator 100, adjacent to one edge, and in equi-circumferentially spaced relation to one another. Stops 106 are dispersed about the outer surface of cylinder plug 102 in a pattern that is complementary to the position of cut-outs 86 in barrel shield 52. As a result, when rear insulator 100 enters rear opening 78 of barrel shield 52, stops 106 are received by cut-outs 86 thereby allowing rear insulator 100 to be inserted by a predetermined amount into barrel shield 52 (FIG. 4).

Figure 6:
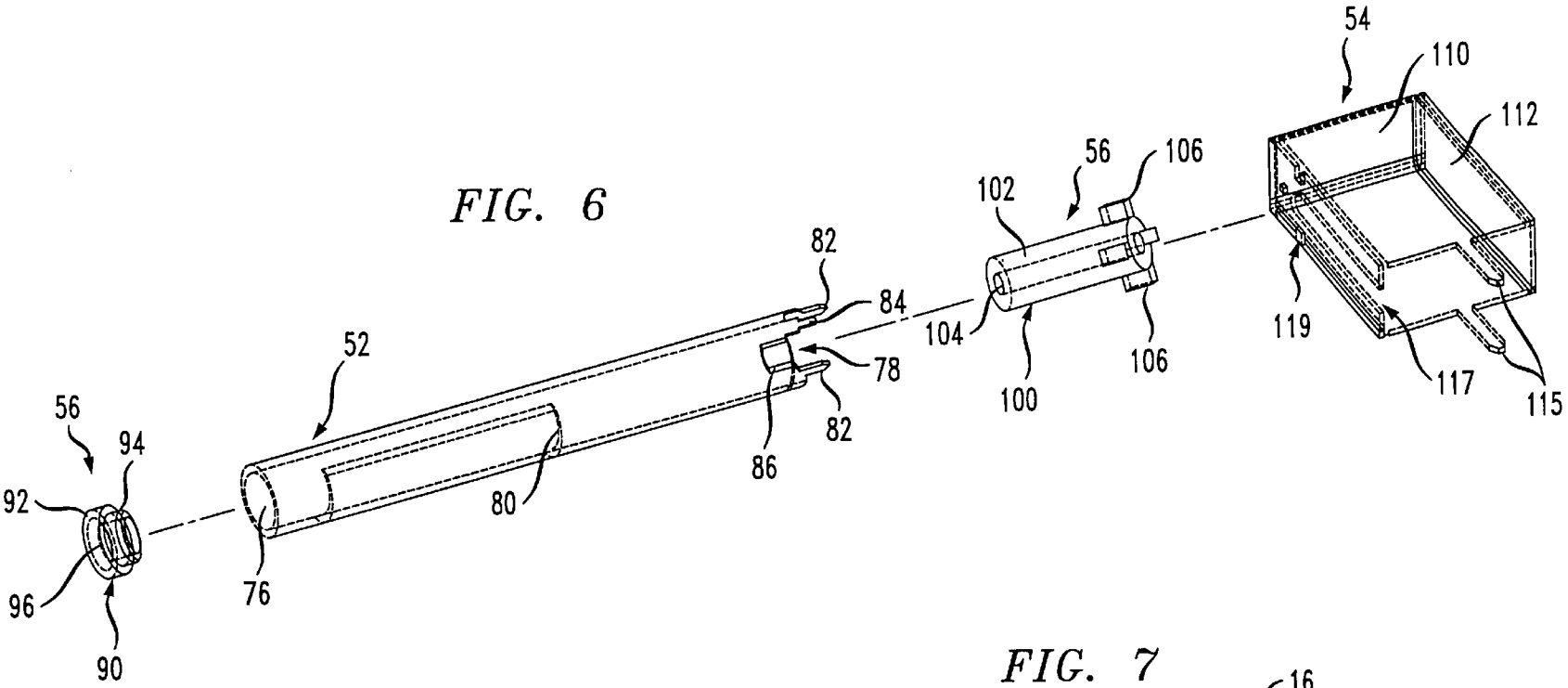
FIG. 6 is an exploded perspective view, partially in phantom, of a signal conductor shield assembly formed according to the invention.

Base shield 54 is formed from an electrically conductive metal or metalized plastic, and has a rectilinear profile that is sized and shaped to be relatively snugly received within base portion 19 of housing 12. An interior void is surrounded by a top 110, four walls 112, and communicates with an open bottom side (FIG. 6). Two of side walls 112 include a pin 115 that projects downwardly from a bottom edge thereof, and is sized and shaped to mechanically and electrically engage a corresponding receptacle, e.g., a printed wiring board plated-through-hole, or the like. A front wall of base shield 54 includes a slot 117 that is sized to receive terminal conductor 64 without mechanically or electrically engaging it. Three openings 119 are positioned in equi-spaced relation about the upper portion of slot 117, and are sized and shaped to receive and mechanically and electrically engage tines 82 and keying-tine 84 of barrel shield 52. It will be understood that one opening 119 is positioned at a "twelve o'clock" location when viewing slot 117 of base shield 54 from the front. This position corresponds to the position of keying-tine 84. In this way, keying-tine 84 defines the proper alignment of shielded center conductor assembly 16 within housing 12 by forcing an orientation of barrel shield 52 that allows for the insertion of keying-tine 84 into top opening 119.

Shielded center conductor assembly 16 is assembled by first mounting front insulator 90 adjacent to the rear portion of receptacle 60. Once front insulator 90 is in position, central conductor 62 and terminal conductor 64 are inserted through front opening 76 of barrel shield 52 so that front opening 76 snugly receives central cylindrical projection 94 of front insulator 90. Referring to FIG. 7, when insulator 90 is fully seated in front opening 76, section 66 of central conductor 62 protrudes out of access window 80. Once in this position, terminal contact pin 70 is inserted through central through-bore 104 of rear insulator 100. Rear insulator 100 is then slid along terminal conductor 64 until it engages annular stop 68. In this position, plurality of stops 106 are positioned within cut-outs 86 and in spaced relation to annular stop 68. With barrel shield 52 fully assembled to signal conductor 50, base shield 54 may be assembled to barrel shield 52 so as to complete shielded conductor assembly 16. More particularly, barrel shield 52 and signal conductor 50 are oriented so that tines 82 and keying-tine 84 are oriented so as to be received by openings 119. Keying-tine 84 acts to predetermine the orientation of terminal conductor 64 so terminal contact pin 70 projects outwardly from the open bottom side of base shield 54.

Referring to FIGS. 2 and 3 again, jack switch assembly 18 is positioned within housing 12, and disposed in cooperative relation with ground spring shell 14 and signal conductor 50. Jack switch assembly 18 includes a first switch contact 130 in the form of an elongate, bifurcated resilient metallic strip which includes two spring arms 132, a root 134, and a free end 136. Each spring arm 132 includes a free end that is supported by a switch contact support portion 138 of base portion 19 that is provided on each inner side of ground spring shell 14. Switch contact support portion 138 is laterally positioned, relative to the longitudinal axis of housing 12, on either side of shielded center conductor assembly 16. Spring arms 132 of first switch contact 130 extend from switch contact supports 138, through ground spring shell 14, toward opening 20, with a predetermined inclination, for example, of about 20 degrees with respect to the longitudinal axis of housing 12. Spring arms 132 pass on diametrically opposed sides of barrel shield 52, but the inner edges of arms 132 do not contact barrel shield 52 (FIG. 2). Spring arms 132 join at root 134, and free end 136 is positioned on a side of the longitudinal axis of housing 12 that is below barrel shield 52. Root 134 is positioned and configured so as to have an inner edge, extending between spring arms 132, that will make electrical contact with section 66 of central conductor 62, through access window 80, in the absence of a mating plug engaged in section 42 of ground spring shell 14 (FIG. 3). Preferably, root 134 exerts a preload contact force against section 66, for example, by making it necessary to urge spring arms 132 radially downwardly when assembling the jack to allow shielded center conductor assembly 16 to slide between spring arms 132. In this way, section 66 slides over and against the inner edge of root 134. One of spring arms 132 continues to extend axially from contact support portion 138 toward base portion 19 of housing 12. This portion of spring arm 132 may form a right-angle bend and exit the opening in the bottom of base portion 19 to form a switch contact terminal 140*a* that projects from the jack housing.

An elongate actuator 142 is supported for pivotal movement on the inner periphery of ground spring shell 14, on a leaf spring 144 formed in section 42 of ground spring shell 14. Actuator 142 is located on the same side of the longitudinal axis of housing 12 as free end 136 of first switch contact 130. Actuator 142 extends axially toward the rear of ground spring shell 14, and an engaging part 146 at the rear end ofactuator 142 protrudes in the mating plug travel path inside ground spring shell 14. Engaging part 146 is configured to cause free end 136 of first switch contact 130 to deflect by an amount sufficient to break the electrical connection between first switch contact 130 and section 66 of central conductor 62, when a mating plug, that has been inserted into ground spring shell 14, displaces engaging part 146. Prior to displacing free end 136 of first switch contact 130, actuator 142 displaces a second switch contact 150 which is constructed and arranged as follows.

More particularly, second switch contact 150 has a generally "L"-shaped profile, having a long "leg" 152 of the contact with an end supported by switch contact support 138. Leg 152 extends within and through ground spring shell 14, substantially parallel to the longitudinal axis of housing 12, bends at substantially a right angle to form an open ring 154. In this arrangement, shielded center conductor assembly 16 clearly passes through ring 154 without contacting it. Ring 154 has a bottom contact hook 156 (FIG. 3) on the same side of the longitudinal axis of housing 12 as free end 136 of first switch contact 130. Engaging part 146 of actuator 142 rests on hook 156 of second switch contact 150. Hook 156 and a contact pad 158 on free end 136 of first switch contact 130, form a predetermined gap between one another. Leg 152 of second switch contact 150 also extends axially toward the rear of housing 12. Leg 152 may be formed to a right-angle and exits the bottom opening in base portion 19, and projects from housing 12 to form a switch contact terminal 140*b*.

When constructed as described herein, coaxial jack 10 has a fully internal switch mechanism, with external switch contact terminals and jack mounting pins. The jacks are thus suitable for mounting on a printed wiring board whether upright, or flush with a right-angle orientation relative to the board. In the illustrated embodiments, the internal switch mechanism is such that in the absence of a mating plug in the jack, first switch contact 130 is in electrical contacting relation with section 66 of central conductor 62, and the electrical potential of signal conductor 50 is the same as that of switch terminal 140*a*. Advantageously, central conductor 62 is shielded by barrel shield 52, and the diameter of central conductor 62 and the length of first switch contact 130 determine the point of contact and mating force of this electrical connection. It should be noted that seventy-five ohm impedance is achieved by preselecting the ratio of the inner diameter of cylindrical barrel 13 to the outer diameter of center conductor 62 at approximately 3.5 to 1. A ratio of 3.5 to 1 is also maintained between the diameter of signal conductor 50 and the inner diameter of barrel shield 52 for this same reason.

When a mating plug is inserted into coaxial jack 10, a leading end of the plug displaces engaging part 146 of actuator 142 inside ground spring shell 14, and causes actuator 142 to deflect downwardly to urge hook 156 of second switch contact 150 against contact pad 158 on free end 136 of first switch contact 130. Engaging part 146 protrudes in the travel path of an inserted mating plug to such a degree that, when deflected by the plug, engaging part 146 urges hook 156 of second switch contact 150 against free end 136 of first switch contact 130 and continues to deflect the both of them enough to break the electrical connection between first switch contact 130 and section 66 of central conductor 62. Thus, when a mating plug is inserted into coaxial jack 10, first switch contact 130 breaks its electrical connection with section 66 of central conductor 62, and makes an electrical connection with second switch contact 150. Ring 154 of second switch contact 150 is large enough so that second switch contact 150 does not make electrical contact with barrel shield 52 when the former is fully deflected by actuator 142. Accordingly, with a mating plug inserted into coaxial jack 10, external jack switch terminals 140*a*, 140*b* are internally connected to one another, via first switch contacts 130,150 and terminal contact pin 70 is internally disconnected from terminal 140*a*.

Use of the present coaxial jack construction in a DSX-3 module can realize as much as a 50 percent reduction in manufacturing costs over present DSX-3/4 modules with 1201A jack sets. Further, a 440 jack made according to the invention will facilitate the creation of an expanded DSX-3 product family. In addition, coaxial jack 10 may be used in high frequency patching applications, e.g., >55 Mb/s, without significant degradation of signal, due to the high degree of electrical isolation of signal conductor 50 provided by barrel shield 52 and base shield 54.

The construction and arrangement of first and second switch contacts 130,150 gives each of them a long moment arm between a point at which actuator 142 transmits a force on the contact, and points at the back ends of the contacts where they are supported by contact support 138, in a relatively narrow cross-section inside ground spring shell 14. The advantage of such a long moment arm is that it allows for a large contact deflection before contact yield, and therefore better switch reliability. Further, the placement of actuator 142 on a leaf part of ground spring shell 14 further improves transmission performance and reduces the number of parts. Transmission performance is yet further enhanced by the high degree of electrical isolation of signal conductor 50 from the active components of jack switch assembly 18 provided by barrel shield 52 and base shield 54. The switch terminals and mounting pins allow a press-fit or solder interface with a printed wiring board and a minimal, "tweak-free" hand assembly.

It is to be understood that the present invention is by no means limited only to the particular constructions herein disclosed and shown in the drawings, but also comprises any modifications or equivalents within the scope of the claims.

What is claimed is:

1. A coaxial jack connector having an internal switch mechanism and a shielded signal conductor comprising:

a housing;

a shell supported by said housing, said shell having an axis and an axial opening defining a plug travel path inside said shell for a mating plug;

an elongate conductor supported coaxially inside said shell and having a receptacle portion for interconnecting with a corresponding conductor of said plug;

a conductor shield positioned in substantially surrounding relation to a portion of said elongate conductor and including an access window positioned so that a portion of said elongate conductor is accessible;

a switch contact support positioned at a back portion of said shell;

an elongate resilient first switch contact fixed at said switch contact support on one side of said shell axis, wherein said first switch contact extends inside said shell toward said axial opening with a predetermined inclination and has a free end positioned on a side of said shell axis opposite said one side;

wherein said first switch contact is configured and positioned to make an electrical connection with said conductor through said access window of said conductor shield, and inside said shell in the absence of an inserted plug; and an elongate actuator supported on the inner periphery of said shell and extending toward said back portion of said shell, wherein said actuator has an engaging part that protrudes into said plug travel path and is configured to cause said free end of said first switch contact to deflect by an amount sufficient to break said electrical connection between said contact and said conductor when a mating plug travels into said shell and displaces said engaging part of said actuator.

2. A coaxial jack according to claim 1 wherein said conductor comprises a terminal portion and a central portion positioned between said receptacle portion and said terminal portion; and said conductor shield comprises a first shield positioned in substantially surrounding, electrically isolated relation to said central portion of said conductor and including said access window, and a second shield positioned in substantially surrounding, electrically isolated relation to said terminal portion.

3. A coaxial jack according to claim 2 wherein said central portion of said conductor projects axially outwardly from a rear portion of said receptacle and includes a radiused section that protrudes through said access window in said first shield.

4. A coaxial jack according to claim 2 wherein said first shield is formed as an elongate hollow conductive cylinder having an internal diameter sized to receive said conductor and including a front opening, a rear opening, and wherein said access window is centrally disposed between said openings.

5. A coaxial jack according to claim 4 wherein said first shield includes a pair of substantially parallel mating tines that extend from an edge thereof, and are positioned in diametrically spaced relation to one another, and a keying-tine positioned between said diametrically spaced tines.

6. A coaxial jack according to claim 5 wherein said first shield includes a plurality of cut-outs defined in equi-circumferentially spaced relation to one another on said edge.

7. A coaxial jack according to claim 6 wherein said access window is defined by an elongate slot in the wall of said first shield and provides for mechanical and electrical access to said conductor.

8. A coaxial jack according to claim 4 wherein said first shield is electrically isolated from said conductor by a front insulator and a rear insulator wherein said front insulator is sized and shaped to be snugly received within said front opening of said first shield and includes a through-bore that is sized to receive a portion of said conductor; and said rear insulator is sized and shaped so as to be snugly received within said rear opening of said first shield and includes a central through-bore that is sized to receive another portion of said conductor.

9. A coaxial jack according to claim 8 wherein said rear insulator includes a plurality of stops that project radially outwardly from an outer surface thereof, adjacent to one edge, and in equi-circumferentially spaced relation to one another.

10. A coaxial jack according to claim 9 wherein said stops are dispersed about said outer surface of said rear insulator in a pattern that is complementary to a corresponding plurality of cut-outs defined by an edge of said first insulator.

11. A coaxial jack according to claim 2 wherein said second shield comprises an electrically conductive rectilinear profile that is sized and shaped to be relatively snugly received within a portion of said housing adjacent to said first shield.

12. A coaxial jack according to claim 11 wherein said second shield includes a top wall and four side walls that together define an open bottom side wherein three of said side walls include a pin that projects downwardly from a bottom edge thereof, said pins being sized and shaped to mechanically and electrically engage a corresponding receptacle.

13. A coaxial jack according to claim 12 wherein a front one of said sidewalls defines a slot that is sized to receive said terminal portion of said conductor and further defines three openings positioned in equi-spaced relation about an upper portion of said slot that are sized and shaped to receive and mechanically and electrically engage a corresponding portion of said first shield.

14. A coaxial jack according to claim 13 wherein one of said three openings defines a preferred alignment of said first shield within said housing.

15. A coaxial jack according to claim 2 including an elongate resilient second switch contact fixed at a back end by said switch contact support on said one side of said shell axis, the second switch contact having a ring part that at least partially encircles said center conductor and a hook part joined to said ring part on the side of the shell axis opposite said one side, the hook part being constructed and arranged to engage the engaging part of said actuator.

16. A coaxial jack according to claim 2 wherein said cylindrical shell forms an axially extending leaf spring along the plug travel path, and said actuator is mounted on said leaf spring.

17. A coaxial jack according to claim 2 wherein said first switch contact is in the form of a bifurcated metallic strip having a root part at the free end of the contact, and arms extending from the root part and having back ends that are fixed by said switch contact support.

18. A coaxial jack according to claim 17 wherein said root has an inner edge that is (i) positioned within said access window of said conductor shield, and (ii) urged into electrical contact with the center conductor with a certain preload contact force.

19. A coaxial jack according to claim 18 including an elongate resilient second switch contact fixed at a back end by said switch contact support on said one side of said shell axis, said second switch contact having a ring part that at least partially encircles said conductor shield and a hook part joined to said ring part on the side of said shell axis opposite said one side, said hook part being constructed and arranged to engage said engaging part of said actuator, and said root of said first switch contact has a contact surface which together with said hook part of said second switch contact define a switch gap in the absence of a displacement of said engaging part of said actuator.

20. A coaxial jack connector having an internal switch mechanism and a shielded signal conductor comprising:

a housing;

a shell supported by said housing, said shell having an axis and an axial opening defining a plug travel path inside said shell for a mating plug;

an elongate conductor supported coaxially inside said shell and having a receptacle portion for interconnecting with a corresponding conductor of said plug, a terminal portion, and a central portion positioned between said receptacle portion and said terminal portion;

a first shield positioned in substantially surrounding, electrically isolated relation to said central portion of said conductor and including an access window being positioned so that a portion of said elongate conductor is accessible, and a second shield positioned in substantially surrounding, electrically isolated relation to said terminal portion;

a switch contact support fixed at a back portion of said shell;

an elongate resilient first switch contact fixed at a back end by said switch contact support on one side of said shell axis, wherein said first switch contact extends inside said shell toward said axial opening with a predetermined inclination and has a free end positioned on a side of said shell axis opposite said one side;

wherein said first switch contact is configured and positioned to make an electrical connection with said conductor through said access window of said conductor shield, and inside said shell in the absence of an inserted plug; and an elongate actuator supported on the inner periphery of said shell and extending toward said back portion of said shell, wherein said actuator has an engaging part that protrudes into said plug travel path and is configured to cause said free end of said first switch contact to deflect by an amount sufficient to break said electrical connection between said contact and said conductor when a mating plug travels into said shell and displaces said engaging part of said actuator.

* * * * *